US006550550B2

(12) United States Patent
Hanton et al.

(10) Patent No.: US 6,550,550 B2
(45) Date of Patent: Apr. 22, 2003

(54) DOWNHOLE DRILLING APPARATUS

(75) Inventors: John Hanton, Cilandaf Commercial (ID); Tommie A. Freeman, Flower Mound, TX (US); William M. Imwalle, Plano, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/037,154

(22) Filed: Nov. 7, 2001

(65) Prior Publication Data

US 2002/0056572 A1 May 16, 2002

Related U.S. Application Data

(62) Division of application No. 09/507,254, filed on Feb. 18, 2000.

(51) Int. Cl.[7] ..... E21B 7/04

(52) U.S. Cl. ..... 175/61; 175/62

(58) Field of Search ..... 175/23, 92, 93, 175/107, 257, 5–7, 9, 61, 62, 315, 57; 166/50, 117, 117.5, 313

(56) References Cited

U.S. PATENT DOCUMENTS

| | | | | |
|---|---|---|---|---|
| 2,839,270 | A | * | 6/1958 | McCune et al. |
| 4,842,081 | A | | 6/1989 | Parant |
| 4,898,243 | A | | 2/1990 | Lindsey et al. |
| 5,287,921 | A | * | 2/1994 | Blount et al. |
| 5,311,936 | A | | 5/1994 | McNair et al. |
| 5,318,121 | A | | 6/1994 | Brockman et al. |
| 5,318,122 | A | | 6/1994 | Murray et al. |
| 5,322,127 | A | | 6/1994 | McNair et al. |
| 5,325,924 | A | | 7/1994 | Bangert et al. |
| 5,353,876 | A | | 10/1994 | Curington et al. |
| 5,388,648 | A | | 2/1995 | Jordan, Jr. |
| 5,462,120 | A | * | 10/1995 | Gondouin |
| 5,472,057 | A | | 12/1995 | Winfree |
| 5,474,131 | A | | 12/1995 | Jordan, Jr. et al. |
| 5,499,680 | A | * | 3/1996 | Walter et al. |
| 5,499,681 | A | | 3/1996 | White et al. |
| 5,520,252 | A | | 5/1996 | McNair |
| 5,615,740 | A | | 4/1997 | Comeau et al. |
| 6,012,526 | A | | 1/2000 | Jennings et al. |
| 6,012,615 | A | | 1/2000 | Brunet et al. |

FOREIGN PATENT DOCUMENTS

| | | |
|---|---|---|
| EP | 0 701 040 A2 | 3/1996 |

* cited by examiner

*Primary Examiner*—Roger Schoeppel
(74) *Attorney, Agent, or Firm*—Marlin R. Smith

(57) ABSTRACT

A downhole drilling apparatus for interconnection in a casing or liner string having a drill bit disposed thereon for enabling the drilling of intersecting wellbores without removal of the drill bit is disclosed. In a disclosed embodiment, the apparatus comprises a housing having a window. A whipstock is disposed within the housing. Between the window and the whipstock is a filler. The whipstock and the filler define a central bore providing a fluid path through the apparatus. A back pressure valve may be disposed within the central bore to prevent back flow of fluids through the apparatus. Once the total depth of an initial wellbore is reached, the casing or liner string, including the apparatus, may be cemented in place. Thereafter, an intersecting wellbore may be drilled by laterally deflecting a second drill bit with the whipstock through the window of the housing.

21 Claims, 4 Drawing Sheets

10
28
26
12
18
20
22
16
42
34
44
40
38
36
24
30
14
32

70
88
86
72
78
80
82
76
104
94
106
102
100
98
84
90
96
74
92

DOWNHOLE DRILLING APPARATUS

This application is a division of application Ser. No. 09/507,254 filed Feb. 18, 2000.

BACKGROUND OF THE INVENTION

This invention relates in general to drilling a wellbore and, in particular, to drilling an intersecting wellbore through a drill string including well casing or liner and a downhole drilling apparatus interconnected therein.

Without limiting the scope of the invention, its background is described in connection with drilling a wellbore for hydrocarbon production, as an example.

Heretofore, in this field, a typical drilling operation has involved attaching a drill bit on the lower end of a drill string and rotating the drill bit along with the drill string to create a wellbore through which subsurface formation fluids may be produced. As the drill bit penetrates the various earth strata to form the wellbore, additional joints of drill pipe are coupled to the drill string. During drilling, drilling fluid is circulated through the drill string and the drill bit to force cuttings out of the wellbore to the surface, and to cool the drill bit.

Periodically as the drilling of the wellbore progresses, the drill bit and drill string are removed from the wellbore and tubular steel casing is inserted into the wellbore to prevent the wall of the wellbore from caving in during subsequent drilling. Typically, after casing is inserted into the wellbore, the annulus between the casing and wellbore is filled with a cement slurry that hardens to support the casing in the wellbore. Thereafter, deeper sections of wellbore with progressively smaller diameters than the previously installed casing may be drilled.

Once a predetermined depth is reached for each subsequent section of wellbore, the drill bit and drill string are again removed from the wellbore and that section of the wellbore may be cased. Alternatively, however, a liner may be used to case an open section of wellbore instead of a full casing string. The liner, which is a string of connected lengths of tubular steel pipe joints, is lowered through the casing and into the open wellbore. At its upper end, the liner is attached to a setting tool and liner hanger. The liner hanger attaches the liner to the previous casing such that the casing will support the weight of the liner.

The length of the liner is predetermined such that its lower end will be proximate the bottom of the open wellbore, with its upper end, including the liner hanger, overlapping the lower end of the casing above. As with the casing, after the liner is inserted into the wellbore, the annulus between the liner and the wellbore may be filled with a cement slurry that hardens to support the liner in the wellbore.

It has been found, however, that in many well drilling operations it is desirable to minimize rig time by utilizing the casing or liner string as the drill string for rotating a drill bit, which may be left in the wellbore upon the completion of drilling a section of the wellbore. As such, this procedure does not require the use of a separate liner or casing upon the withdrawal of the drill bit and drill string as in conventional drilling operations, and thereby reduces the time needed to drill, case and cement a section of wellbore.

For example, attempts have been made to utilize the casing or liner string as the drill string along with a drill bit that is rotatable relative to the casing or liner string. The drill bit is rotated by a downhole drill motor that is driven by drilling fluid. Upon completion of drilling operations, the motor and the retrievable portions of the drill bit may be removed from the wellbore so that further wellbore operations, such as cementing, may be carried out and further wellbore extending or drilling operations may be conducted. This system, however, requires the use of expensive and sometimes unreliable downhole drill motors and a specially designed drill bit.

Alternatively, other attempts have been made to utilize the casing or liner string as the drill string using conventional rotary techniques wherein the drill bit is rotated by rotating the entire casing or liner string. This approach, however, requires the use of a drill bit with minimal cutting structure, since a drill out could not be performed through a typical drill bit having a full cutting structure, such as a tricone bit.

Therefore, a need has arisen for a drill string which may be used as a well casing or liner, which includes a drill bit on its lower end, and which, upon completion of drilling operations, may be retained within the wellbore without the need to retrieve the drill bit or the drill string. A need has also arisen for such a well casing or liner string that may be left in the wellbore along with a drill bit, and which does not require the use of expensive, unreliable or specialty equipment. Further, a need has arisen for such a well casing or liner string which may be cemented in place along with a drill bit having a full cutting structure.

SUMMARY OF THE INVENTION

The present invention, as exemplified by an embodiment disclosed herein, comprises a downhole drilling apparatus that is interconnectable in a casing or liner drill string and includes a drill bit connected thereto which, upon completion of drilling operations, may be retained within the wellbore without the need to retrieve the drill bit or the drill string. The apparatus allows the well casing or liner to be left in the wellbore along with the drill bit and does not require the use of expensive, unreliable or specialty equipment. The apparatus also allows for the well casing or liner to be cemented in place along with a drill bit having a full cutting structure.

The downhole drilling apparatus includes a housing that is interconnectable in a casing string. The housing has a window cut therein to allow a subsequent drill bit and pipe string to pass therethrough during a drill out operation. To facilitate the deflection of the drill bit and pipe string through the window, a whipstock is disposed within the housing. A filler material is also disposed within the housing between the whipstock and the window to prevent the flow of drilling fluids or cement through the window prior to the drill out. The filler and the whipstock have a central bore that permits the passage of fluids through the center of the downhole drilling apparatus. One or more valves may be disposed within the central bore to control the flow of fluids therethrough. The valves may be, for example, back pressure or float valves that allow one-way flow of fluids downwardly through the apparatus.

A drill bit having a full cutting structure, such as a tricone bit, may be operably coupled to the downhole drilling apparatus. The casing or liner string may be used to rotate the drill bit. Alternatively, a downhole motor may be coupled between the downhole drilling apparatus and the drill bit to facilitate rotation of the drill bit, without the need for rotating the casing string.

In another embodiment, a downhole drilling apparatus includes a housing having a window, an alignment member disposed within the housing and a back pressure valve assembly. The back pressure valve assembly includes a central bore that permits the passage of fluids therethrough. Once downhole, a whipstock may be run into the apparatus such that the whipstock operably engages the alignment member. The alignment member orients the whipstock within the housing relative to the window, so that the drill bit may subsequently be deflected through the window.

In operation, either embodiment of the downhole drilling apparatus may be interconnected in a casing or liner string having a drill bit disposed on its lower end. A first wellbore is drilled. Following the drilling of the first wellbore, the casing or liner string may be cemented within the wellbore. A pipe string having another drill bit on its lower end is passed through the casing or liner string, such that a drill out through the downhole drilling apparatus is performed to drill a second wellbore. The pipe string and drill bit that are used to create the second wellbore are deflected through the window in the housing of the downhole drilling apparatus by the whipstock disposed within the apparatus.

Thus, with the use of the downhole drilling apparatus, a casing or liner string including a drill bit having a full cutting structure may be used as a drill string to create a wellbore. The drill string may be cemented in place within the wellbore, and thereafter have a drill out performed therethrough to create an intersecting wellbore.

These and other features, advantages, benefits and objects of the present invention will become apparent to one of ordinary skill in the art upon careful consideration of the detailed description of representative embodiments of the invention hereinbelow and the accompanying drawings.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not limit the scope of the invention.

Figure 1:
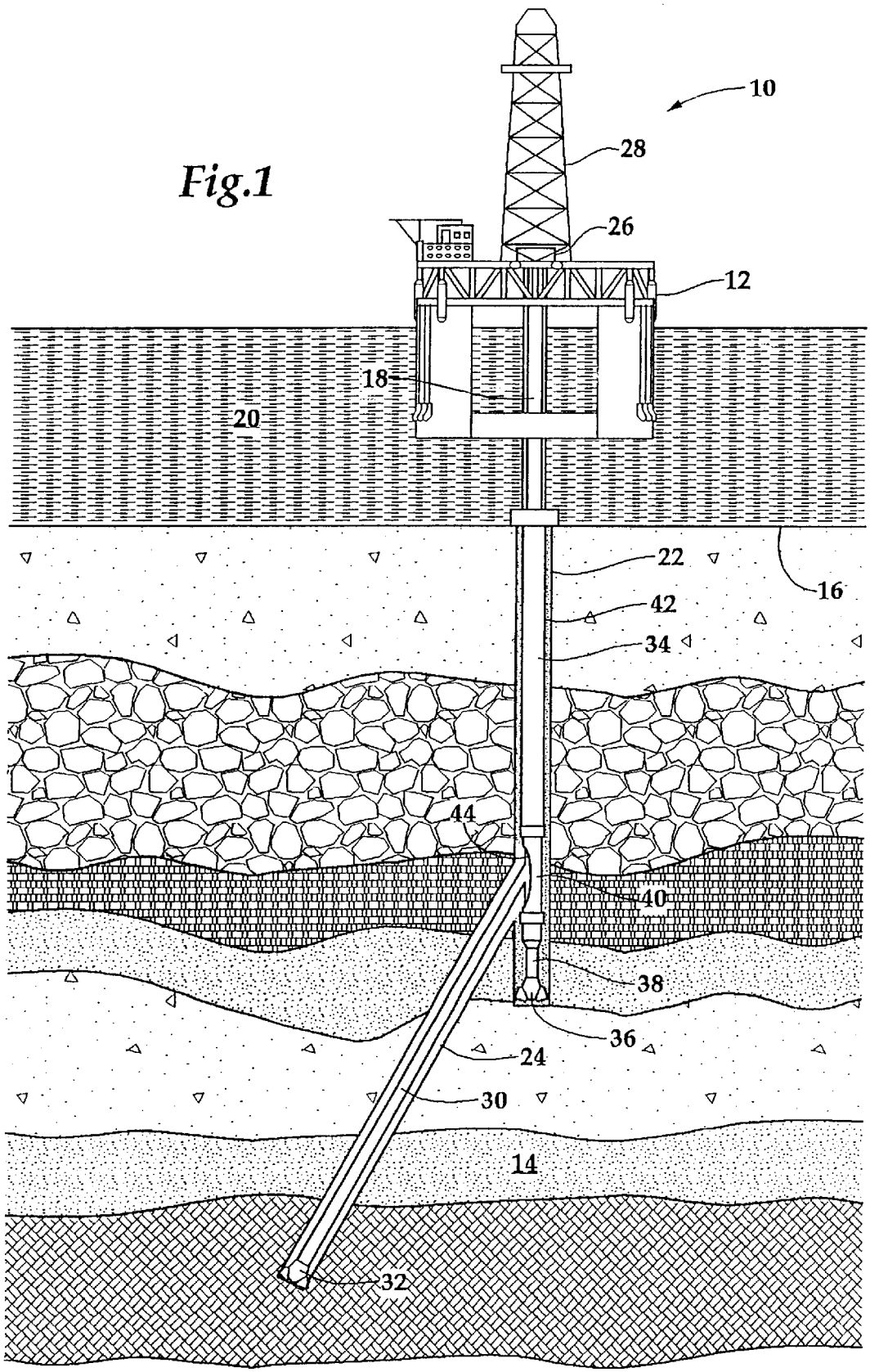
FIG. 1 is a schematic illustration of an offshore oil and gas platform during a drilling operating wherein a downhole drilling apparatus embodying principles of the present invention is utilized.

Referring to FIG. 1, an offshore oil and gas platform is schematically illustrated and generally designated 10. A semi-submersible platform 12 is centered over a subterranean oil and gas formation 14 located below sea floor 16. A well 18 extends through the sea 20, penetrating sea floor 16 to form wellbore 22, which traverses various earth strata. A wellbore extension is formed by wellbore 24, which extends from wellbore 22 through additional earth strata, including formation 14.

Platform 12 has a hoisting apparatus 26 and a derrick 28 for raising and lowering pipe strings, such as drill string 30, including drill bit 32 located in wellbore 24, and casing string 34, including drill bit 36, crossover subassembly 38 and downhole drilling apparatus 40 located in wellbore 22. As used herein, the term "casing string" is used to refer to a tubular string which includes sections of casing or liner.

As in a typical drilling operation, wellbore 22 is formed by rotating drill bit 36 while adding additional sections of pipe to casing string 34. When drill bit 36 reaches total depth, however, casing string 34 and drill bit 36 are not retrieved from wellbore 22. Rather, casing string 34 and drill bit 36 are cemented in place by cement 42 which fills the annular area between casing string 34 and wellbore 22.

Cementing casing string 34 and drill bit 36 in place within wellbore 22 is a cost effective alternative to conventional drilling, in that significant rig time is saved by minimizing the number of trips into and out of wellbore 22. At least one trip out of wellbore 22 and one trip into wellbore 22 are saved by using downhole drilling apparatus 40. Additionally, the use of downhole drilling apparatus 40 avoids the possibility of collapse of wellbore 22, particularly in unconsolidated or weakly consolidated formations.

Alternatively, downhole drilling apparatus 40 may be used in conjunction with conventional drilling operations once a conventional drill string and bit have been tripped out of wellbore 22. For example, if wellbore 22 has traversed an unconsolidated or weakly consolidated formation and it is likely that a collapse has occurred within wellbore 22, it may be necessary to reopen that portion of wellbore 22. In this case, wellbore 22 may be reopened using casing string 34 with downhole drilling apparatus 40 and drill bit 3 6.

Once cementing of wellbore 22 has been completed, wellbore 24 may be drilled. Drill bit 32 creates wellbore 24 by traveling through window 44 of downhole drilling apparatus 40, as will be more fully discussed with reference to FIGS. 2–4 below. As drill bit 32 and drill string 30 continue to form wellbore 24, formation 14 is traversed. Note that the drill string 30 may include another apparatus 40, if desired.

Even though FIG. 1 depicts wellbore 22 as a vertical wellbore, it should be understood by those skilled in the art that wellbore 22 may be vertical, substantially vertical, inclined or even horizontal. It should also be understood by those skilled in the art that wellbore 22 may include multilateral completions wherein wellbore 22 may be the primary wellbore having one or more branch wellbore extending laterally therefrom, or wellbore 22 may be a branch wellbore. Additionally, while FIG. 1 depicts an offshore environment, it should be understood by one skilled in the art that the use of downhole drilling apparatus 40 is equally well suited for operation in an onshore environment.

Figure 2:
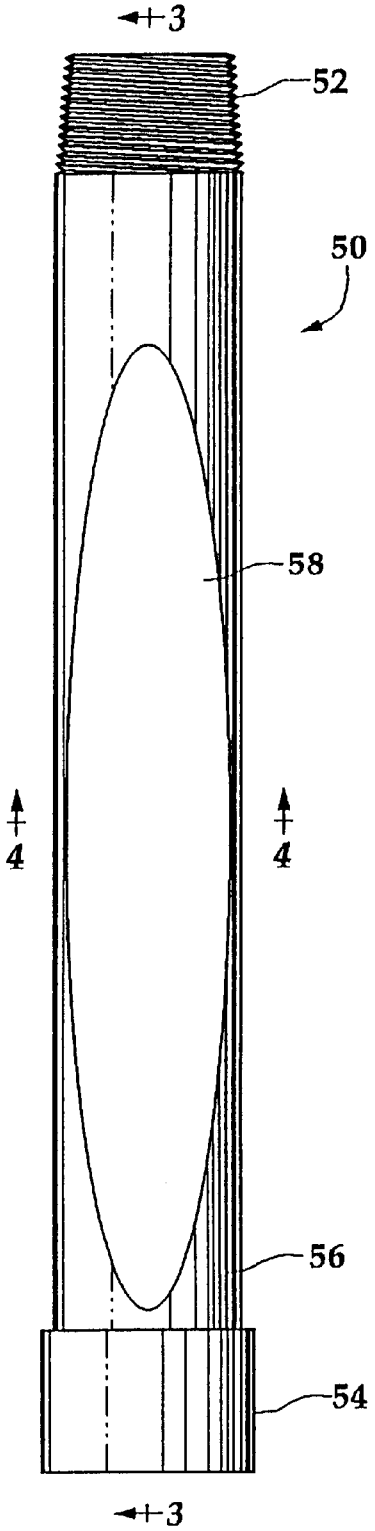
FIG. 2 is a schematic illustration of a first downhole drilling apparatus embodying principles of the present invention.

Schematically illustrated in FIG. 2 is a downhole drilling apparatus 50 embodying principles of the present invention. Apparatus 50 has a pin end 52, so that the apparatus 50 is interconnectable in a drill string, such as casing string 34 of FIG. 1. Downhole drilling apparatus 50 also has a box end 54 that may be threadedly connected to crossover subassembly 38 as depicted in FIG. 1.

Apparatus 50 has a generally tubular housing 56 with a window 58 cut through a sidewall thereof. Window 58 is generally elliptically shaped and is sized such that a drill bit, such as drill bit 32 of FIG. 1, may pass therethrough during a drill out operation.

Figure 3:
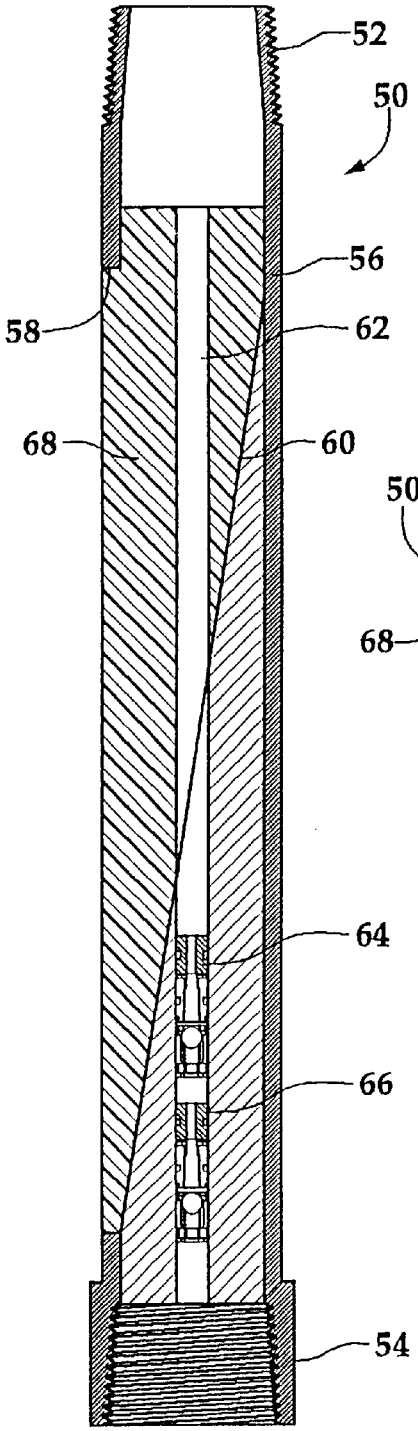
FIG. 3 is a cross sectional view of the downhole drilling apparatus of FIG. 2, taken along line 3—3.

Now referring to FIG. 3, a cross sectional view of downhole drilling apparatus 50 taken along line 3—3 of FIG. 2 is depicted. Disposed within housing 56 of apparatus 50 is a whipstock 60. A central bore 62 extends through whipstock 60 to provide fluid passage for drilling mud and cement through apparatus 50 during drilling and cementing operations. Valves 64, 66 are disposed within central bore 62 of the downhole drilling apparatus 50. Valves 64, 66 may be back pressure or float valves that allow one-way flow of drilling mud or cement through the apparatus 50. As an example, valves 64, 66 may be SuperSeal II back pressure valves, available from Halliburton Energy Services, Inc. of Duncan, Okla.

Whipstock 60 has an inclined upper surface, so that it directs a drill bit, such as drill bit 32 of FIG. 1, through window 58 of downhole drilling apparatus 50. Whipstock 60 may be constructed of any material, such as steel, having sufficient strength to deflect a drill bit through window 58. Whipstock 60 may also provide additional torsional strength to the downhole drilling apparatus 50.

A filler 68 occupies the volume between whipstock 60 and window 58 of downhole drilling apparatus 50. Filler 68 prevents the flow of drilling mud or cement through window 58 of apparatus 50. Filler 68 may be, for example, concrete that has been poured into downhole drilling apparatus 50. Window 58 may also be filled with filler 68 to provide protection to window 58. Other suitable solid materials, such as resins, may be used for filler 68, so long as they set sufficiently and permit the directional passage of a drill bit through window 58 of apparatus 50.

In operation, when a drill bit, such as drill bit 32 of FIG. 1, encounters whipstock 60, the drill bit cuts through filler 68 and is deflected laterally by whipstock 60 toward window 58 in housing 56. Window 58 is wider that the outer diameter of the drill bit, permitting the drill bit to laterally exit the apparatus 50.

Figure 4:
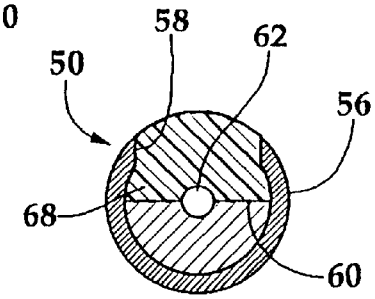
FIG. 4 is a cross sectional view of the downhole drilling apparatus of FIG. 2, taken along line 4—4.

Referring now to FIG. 4, a cross sectional view of downhole drilling apparatus 50 is depicted that is taken along line 4—4 of FIG. 2. Apparatus 50 includes housing 56, whipstock 60, filler 68 and window 58. As with typical drill down shoes, downhole drilling apparatus 50 may have sufficient torsional strength to rotate a drill bit, such as drill bit 36 of FIG. 1. The wall thickness of housing 56 and the size of window 58 will affect the torsional strength of downhole drilling apparatus 50. Of course, the window 58 should be dimensioned to permit a drill bit to pass therethrough.

The shape of whipstock 60 can be varied to maximize its deflecting capability. For example, whipstock 60 may be made concave or convex to direct a drill bit, such as drill bit 32, through window 58 of downhole drilling apparatus 50. If whipstock 60 is made concave, drill bit 32 will encounter window 58 at a position slightly below that where a straight whipstock 60 would direct the bit. Conversely, a convex whipstock 60 will force the encounter of drill bit 32 with window 58 at a position above that of the flat-surfaced whipstock 60.

Figure 5:
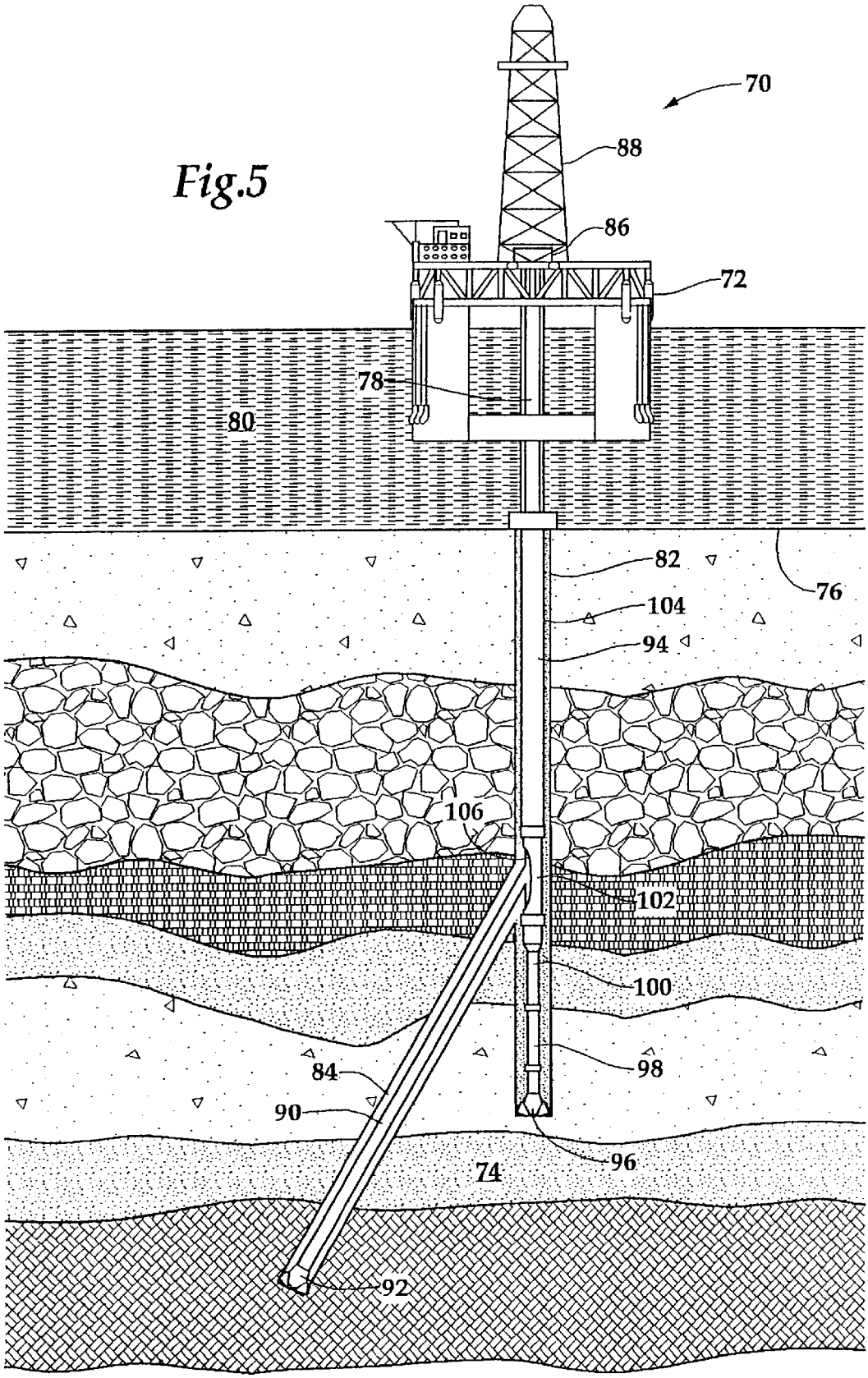
FIG. 5 is a schematic illustration of an offshore oil and gas platform during a drilling operating wherein a downhole drilling apparatus embodying principles of the present invention is being utilized in conjunction with a downhole motor.

Referring now to FIG. 5, an offshore oil and gas platform is schematically illustrated and generally designated 70. A semi-submersible platform 72 is centered over a subterranean oil and gas formation 74 located below sea floor 76. A well 78 extends through the sea 80, penetrating sea floor 76 to form wellbore 82, which traverses various earth strata. Wellbore 82 has a wellbore extension that is formed by wellbore 84, which extends from wellbore 82 through additional earth strata, including formation 74.

Platform 72 has a hoisting apparatus 86 and a derrick 88 for raising and lowering pipe strings, such as drill string 90, including drill bit 92 located in wellbore 84, and casing string 94, including drill bit 96, downhole motor 98, crossover subassembly 100 and downhole drilling apparatus 102 located in wellbore 82. Using downhole motor 98, it is not necessary to rotate casing string 94, including downhole drilling apparatus 102, in order to rotate drill bit 96.

Drilling mud, used to cool drill bit 96 and carry cuttings to the surface, also provides the power to operate downhole motor 98. As the drilling mud travels through downhole motor 98, downhole motor 98 imparts rotation to drill bit 96, so that wellbore 82 is drilled. Using downhole motor 98 in conjunction with downhole drilling apparatus 102 reduces the torsional stress typically encountered by downhole drilling apparatus 102 when casing string 94 is used to rotate drill bit 96. This reduction in torsional stress allows for the use of a maximum width window 106 in downhole drilling apparatus 102.

When drill bit 96 reaches total depth, casing string 94, including drill bit 96, downhole motor 98, crossover subassembly 100 and downhole drilling apparatus 102, is not retrieved from wellbore 82. Rather, casing string 94 is cemented in place by cement 104, which fills the annular area between casing string 94 and wellbore 82.

Once cementing of wellbore 82 has been completed, wellbore 84 may be drilled using downhole drilling apparatus 102. Drill bit 92 creates wellbore 84 by traveling through window 106 of downhole drilling apparatus 102 in the manner discussed above with reference to FIGS. 2–4.

Figure 6:
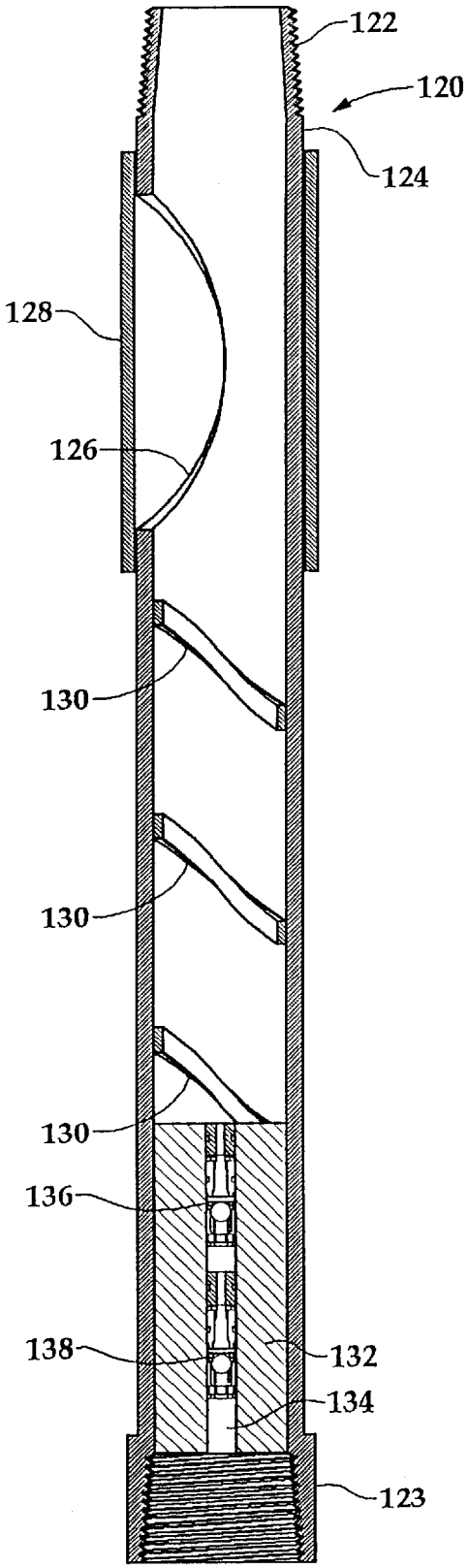
FIG. 6 is a cross sectional view of a second downhole drilling apparatus embodying principles of the present invention before insertion of a whipstock therein.

Referring next to FIG. 6, a cross sectional view of another downhole drilling apparatus 120 embodying principles of the present invention is depicted. Downhole drilling apparatus 120 has a pin end 122, so that downhole drilling apparatus 12 is interconnectable in a drill string, such as casing string 94 of FIG. 5, or to other downhole tools. Downhole drilling apparatus 120 also has a box end 123 which may be threadedly connected to crossover subassembly 100 as depicted in FIG. 5.

Apparatus 120 has a generally tubular housing 124 with a window 126 cut through a sidewall thereof. Window 126 is generally elliptically shaped and is sized such that a drill bit, such as drill bit 92 of FIG. 5, may pass therethrough during a drill out operation. Surrounding window 126 is a cover or shield 128 that prevents the flow of drilling mud or cement through window 126. Apparatus 120 also has at least one alignment member 130, such as a track, within housing 124.

Disposed within housing 124 is a back pressure valve assembly 132. A central bore 134 extends through back pressure valve assembly 132 to provide fluid passage for drilling mud and cement used during drilling and cementing operations. Valves 136, 138 are disposed within central bore 134 of back pressure valve assembly 132. Valves 136, 138 may be back pressure valves or float valves that allow one-way flow of drilling mud or cement therethrough.

Figure 7:
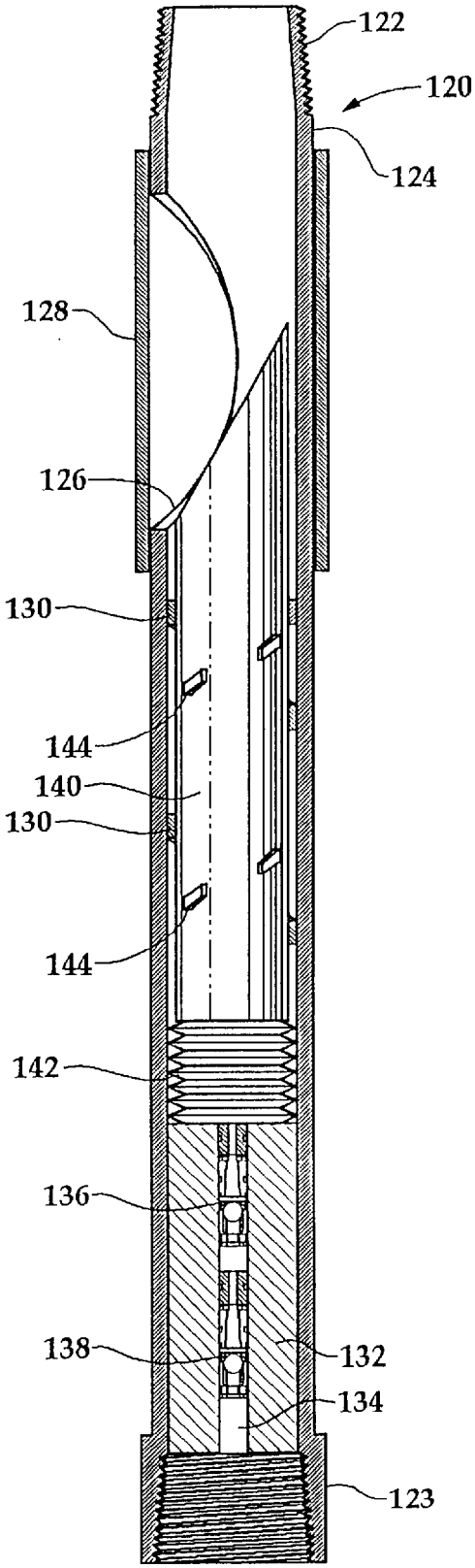
FIG. 7 is a cross sectional view of the second downhole drilling apparatus after insertion of a whipstock therein.

As best seen in FIG. 7, a whipstock 140 may be run into downhole drilling apparatus 120 to direct a drill bit, such as drill bit 92 of FIG. 5, through window 126 of apparatus 120. Whipstock 140 may be installed within downhole drilling apparatus 120 following a cementing operation and subsequent use of a conventional cementing plug 142. Whipstock 140 includes one or more alignment lugs 144 that cooperate with track 130 of downhole drilling apparatus 120 to radially orient whipstock 140 with respect to window 126.

After cementing the casing string 94 within wellbore 82, including installing the plug 142 in the drilling apparatus 120, the whipstock 140 is conveyed into the drilling apparatus. The alignment track 130 and lugs 144 cooperatively engage and thereby radially orient the whipstock 140 to face toward the window 126. A drill bit may then be deflected off of the whipstock 140 to cut through the shield 128, or the shield may be previously displaced to open the window 126, for example, by using a conventional shifting tool.

In the embodiments described above, the present invention provides the ability to drill a wellbore using a well casing or liner string as the drill string, and using a drill bit having a full cutting structure. The use of a downhole drilling apparatus embodying principles of the present invention as part of the drill string allows a well extension to be drilled from the existing wellbore, without having to bore through a drill bit on the end of the casing or liner string. Thus, trips into and out of the wellbore may be eliminated and a drill bit having a full cutting structure may be used.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A method of drilling intersecting first and second wellbores, the method comprising the steps of:

coupling a downhole drilling apparatus within a first pipe string, the first pipe string having a first drill bit disposed on a lower end thereof;

drilling the first wellbore;

disposing a second drill bit on a lower end of a second pipe string;

running the second drill bit into the first pipe string; and drilling laterally through the downhole drilling apparatus to drill the second wellbore.

2. The method according to claim 1, further comprising the step of cementing the first pipe string within the first wellbore.

3. The method according to claim 1, further comprising the step of disposing a downhole motor between the downhole drilling apparatus and the first drill bit.

4. The method according to claim 1, wherein in the coupling step the downhole drilling apparatus includes a housing having a window, a whipstock disposed within the housing, a filler disposed within the housing between the window and the whipstock, and a bore extending through the housing and permitting passage of fluids therethrough.

5. The method according to claim 4, wherein the step of drilling through the downhole drilling apparatus further includes drilling through the window in the housing of the downhole drilling apparatus.

6. The method according to claim 4, wherein the step of drilling through the downhole drilling apparatus further includes deflecting the second drill bit through the window with the whipstock.

7. The method according to claim 1, wherein in the coupling step the downhole drilling apparatus includes a housing having a window, an alignment member disposed within the housing, and a back pressure valve assembly operably associated with the housing, the back pressure valve assembly having a central bore that permits the passage of fluids therethrough.

8. The method according to claim 7, further comprising the step of running a whipstock through the first pipe string and operably engaging the whipstock with the alignment member to orient the whipstock within the housing relative to the window.

9. A method of drilling intersecting first and second wellbores, the method comprising the steps of:

drilling at least a portion of the first wellbore utilizing a casing string which includes a generally tubular housing positioned above a first drill bit, the housing having a window formed through a sidewall thereof;

cementing the casing string in the first wellbore; and drilling at least a portion of the second wellbore by deflecting a second drill bit from within the casing string laterally outward through the housing window.

10. The method according to claim 9, wherein the cementing step is performed after the first wellbore drilling step and without removing the casing string from the first wellbore.

11. The method according to claim 9, wherein in the first wellbore drilling step, a whipstock is positioned within the housing.

12. The method according to claim 11, wherein in the first wellbore drilling step, a filler is disposed between the whipstock and the window.

13. The method according to claim 11, wherein the first wellbore drilling step further comprises flowing drilling fluid through the whipstock.

14. The method according to claim 11, wherein the cementing step further comprises flowing cement through the whipstock.

15. The method according to claim 9, wherein in the first wellbore drilling step, a downhole motor is interconnected between the housing and the first drill bit.

16. The method according to claim 9, wherein in the first wellbore drilling step, a shield prevents fluid flow through the housing window.

17. The method according to claim 9, further comprising the step of conveying a whipstock into the housing after the cementing step.

18. The method according to claim 17, further comprising the step of aligning the whipstock with the window by engaging the whipstock with an alignment structure of the housing.

19. The method according to claim 9, wherein in the first wellbore drilling step, a valve is disposed within the housing to control fluid flow therethrough.

20. The method according to claim 19, wherein in the first wellbore drilling step, the valve permits fluid flow through the housing in only one direction.

21. The method according to claim 19, wherein in the first wellbore drilling step, the valve is a back pressure valve.

* * * * *